US007735399B2

(12) United States Patent
Robinson et al.

(10) Patent No.: US 7,735,399 B2
(45) Date of Patent: Jun. 15, 2010

(54) CLAMPING AND CUTTING APPARATUS WITH ADJUSTABLE HEAD

(75) Inventors: Glenn Robinson, Coral Springs, FL (US); Dan M. DeLaRosa, Coral Springs, FL (US)

(73) Assignee: IBT Holdings, Inc, Deerfield Beach, FL (US)

( * ) Notice: Subject to any disclaimer, the term of this patent is extended or adjusted under 35 U.S.C. 154(b) by 0 days.

(21) Appl. No.: 12/006,964

(22) Filed: Jan. 9, 2008

(65) Prior Publication Data

US 2009/0007733 A1 Jan. 8, 2009

Related U.S. Application Data

(60) Provisional application No. 60/958,325, filed on Jul. 5, 2007.

(51) Int. Cl.
*B25B 23/16* (2006.01)
*B25B 7/18* (2006.01)

(52) U.S. Cl. ..... 81/177.8; 81/415

(58) Field of Classification Search ..... 81/177.8, 81/177.9, 415, 424, 416
See application file for complete search history.

(56) References Cited

U.S. PATENT DOCUMENTS

| | | | | |
|---|---|---|---|---|
| 251,825 | A * | 1/1882 | Bruhl | 119/806 |
| 763,745 | A | 6/1904 | Gheen | |
| 1,442,486 | A | 1/1923 | Looke | |
| 1,684,775 | A | 9/1928 | Neikirk | |
| 2,458,725 | A | 1/1949 | Periman | |
| 2,518,139 | A | 8/1950 | Hallowel et al. | |
| 2,556,995 | A | 6/1951 | Coffing | |
| 2,608,894 | A | 9/1952 | Miller, Jr. et al. | |
| 2,886,998 | A | 5/1959 | Scott | |
| 2,921,773 | A | 6/1960 | Hoelzer | |
| 3,383,962 | A | 5/1968 | Harris | |
| D222,689 | S | 12/1971 | Futami | |
| 3,675,359 | A | 7/1972 | Ohno | |
| 3,779,107 | A | 12/1973 | Avery | |
| D258,411 | S | 3/1981 | Futami | |
| 4,463,632 | A | 8/1984 | Parke | |
| 4,711,145 | A | 12/1987 | Inoue | |
| 4,744,272 | A | 5/1988 | Leatherman | |
| 4,794,829 | A | 1/1989 | Mesenholler | |
| 4,829,858 | A | 5/1989 | Kern et al. | |

(Continued)

*Primary Examiner*—David B Thomas
(74) *Attorney, Agent, or Firm*—Dan M. DeLaRosa

(57) ABSTRACT

A device having an adjustable handle and head is provided, and the device comprises: a pair of handles having opposing top and bottom ends, the top end of each of the handles having a U-shaped component; a head comprising a first and second component, each of the components having opposing top and bottom ends, the top end of each of the components having at least one contact surface, the bottom end of each of the components comprising a protrusion, and the protrusion has a plurality of external slots; the U-shaped component of the handles are designed to interact with the protrusion of the bottom end of each of the first and second components of the head, and the first and second components are connected at a pivot point; and a device for engaging the slots of the protrusion to thereby allow movement of the head and lock the head to a desired position, and the handles are designed to be squeezed together to thereby allow the contact surfaces of the first and the second top ends of the first and second components to move towards one another.

26 Claims, 6 Drawing Sheets

U.S. PATENT DOCUMENTS 4,901,608 A 2/1990 Shieh
4,934,222 A 6/1990 Rittmann et al.
5,203,241 A 4/1993 Mattis
5,491,856 A 2/1996 Legg
D368,212 S 3/1996 Johnston
D369,534 S 5/1996 Liou
5,862,723 A 1/1999 Rowlands
5,893,303 A 4/1999 Harris
6,000,302 A 12/1999 Chiang
6,024,000 A 2/2000 Goldmann, II
6,053,076 A 4/2000 Barnes
6,134,994 A 10/2000 Gomas
6,145,417 A 11/2000 Bates et al.
6,148,698 A * 11/2000 Hsieh ..... 81/177.8
6,220,125 B1 4/2001 Lan
D445,319 S 7/2001 Choi
6,270,134 B1 8/2001 Lin
6,282,995 B1 9/2001 Lin
6,295,898 B1 * 10/2001 Hsieh ..... 81/177.8
6,370,992 B1 4/2002 Shih-Kuei
6,408,725 B1 6/2002 Janson
D472,127 S 3/2003 Willinger et al.
6,532,847 B2 3/2003 Liou
D479,789 S 9/2003 Brantley
6,745,650 B1 6/2004 Chang
6,895,839 B1 5/2005 Hsien
6,941,846 B2 9/2005 Hsien
6,957,600 B2 * 10/2005 Hu ..... 81/177.8
7,104,165 B2 * 9/2006 Chu ..... 81/177.8
7,165,480 B2 * 1/2007 Lin ..... 81/177.9
7,171,875 B2 * 2/2007 Hu ..... 81/177.8
7,267,606 B2 * 9/2007 Hsieh ..... 81/177.7
7,343,837 B1 * 3/2008 Domanico et al. ..... 81/177.7
2003/0015070 A1 * 1/2003 Chen ..... 81/177.9
2004/0089117 A1 * 5/2004 Hsien ..... 81/424
2004/0139828 A1 * 7/2004 Chang ..... 81/177.9
2004/0163503 A1 * 8/2004 Hsien ..... 81/177.8
2006/0027053 A1 * 2/2006 Hsien ..... 81/177.2
2006/0027056 A1 * 2/2006 Hsien ..... 81/427
2006/0090613 A1 * 5/2006 Hsieh ..... 81/177.8
2006/0230886 A1 * 10/2006 Hsien ..... 81/424

* cited by examiner

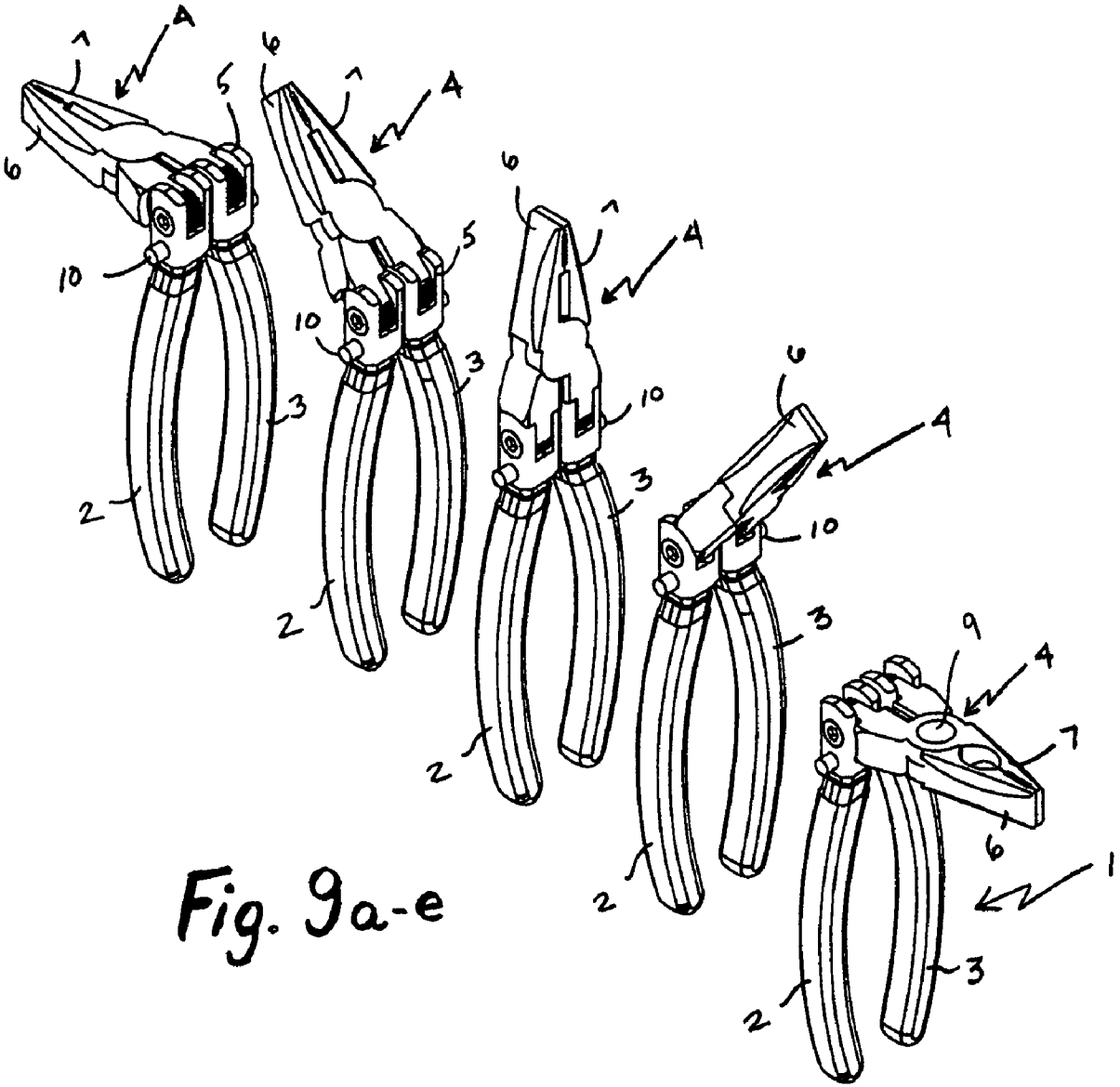
Fig. 9a-e

CLAMPING AND CUTTING APPARATUS WITH ADJUSTABLE HEAD

RELATED APPLICATION

This application is related to U.S. Provisional Application Ser. No. 60/958,325, entitled "Clamping and Cutting Apparatus With Adjustable Head" which was filed on Jul. 5, 2007.

BACKGROUND OF THE INVENTION

1. Field of the Invention

This invention relates to a clamping, cutting and/or clipping apparatus and more particularly, pliers and snips with adjustable head, adjustable head angles, adjustable handles and locking devices.

2. Description of the Related Art

There are various patents covering pliers type device with adjustable head angles. These pliers have a head and a pair of handles wherein the head is pivotally attached to the handles to allow movement of the heads in different angles. U.S. Pat. No. 6,370,992 to Shih-Kuei relates to pliers with moveable heads and heads have a lug attached to projections of handles and are pivotally attached to one another. U.S. Pat. No. 6,941,846 to Hsien relates to pliers having a head with u-shaped ends pivotally attached to protrusions of handles to allow for movement of the head and the handles have arcuate concave resting portions.

There are also various patents that cover ratchets and ratchet wrenches with adjustable angles. These ratchet devices have a handle and a head wherein the head is pivotably attached to the handle to allow for movement of the head in different angles. U.S. Pat. No. 3,779,107 to Avery relates to a ratchet wrench with a fork-shaped handle and a moveable head. U.S. Pat. No. 4,901,608 to Shieh provides for a ratchet wrench with an adjustable head angle. Shieh uses a Y-shaped handle attached to a head with two gears engaging one another to allow for the adjustable head angle. U.S. Pat. No. 6,895,839 to Hsien relates to a control mechanism for adjusting the head of a ratchet wrench and the control mechanism uses a polygonal shaped hole and corresponding portion on a pin. U.S. Pat. No. 6,220,125 to Lan relate to angle adjustable ratchet wrenches.

Unlike the prior art, the present invention provides for pliers and clippers as well as clamping and cutting devices with adjustable heads and handles as well as different control mechanism for movement and locking of the head.

SUMMARY OF THE INVENTION

In one embodiment, the present invention relates to a device having adjustable handles and adjustable head, the device comprises: a pair of handles having opposing top and bottom ends, the top end of each of the handles having a U-shaped component; a head comprising a first and second component, each of the components having opposing top and bottom ends, the top end of each of the components having at least one contact surface, the bottom end of each of the components comprising a protrusion, and the protrusion has a plurality of external slots; the U-shaped component of the handles are designed to interact with the protrusion of the bottom end of each of the first and second components of the head, and the first and second components are connected at a pivot point; and a device for engaging the slots of the protrusion to thereby allow movement of the head and lock the head to a desired position, and the handles are designed to be squeezed together to thereby allow the contact surfaces of the first and the second top ends of the first and second components to move towards one another.

In another embodiment, the device further comprises a mechanism for activating the release and the locking of the head in a desired position. In still another embodiment, the protrusion comprises an aperture and the device further comprises a pin for securing the head to the handle by insertion of the pin into the aperture of the protrusion.

In yet another embodiment, the release and locking device comprises a pin and a spring. In still yet another embodiment, the head is designed to rotate about an axis from about 0 degrees to about 180 degrees. In a further embodiment, the contact surfaces function as clamping contact surfaces, and the device functions as a clamping device.

In another further embodiment, the release and locking device comprises push mechanism. In still a further embodiment, the release and locking device comprises sliding mechanism.

In yet a further embodiment, the external slots of said protrusion functions as a gear. In still yet a further embodiment, the clamping device functions as pliers. In another further embodiment, the each of the contact surfaces of the first and the second top ends of the first and second components comprises cutting surfaces, and the device functions as a cutting device. In still another further embodiment, the cutting device functions as snips. In yet another further embodiment, the cutting device functions as scissors.

In still yet another further embodiment, the present invention relates to a device having an adjustable handle and head, and the device comprises: a pair of handles having opposing top and bottom ends, the top end of each of the handles having a U-shaped component; a head comprising a first and second component, each of the components having opposing top and bottom ends, the top end of each of the components having at least one contact surface, the bottom end of each of the components comprising a protrusion, and the protrusion having a plurality of apertures, and the U-shaped component of the handles designed to interact with the protrusion of the bottom end of each of the head, the first and second components are connected at a pivot point; and a device for engaging the apertures of the protrusion to thereby allow movement of the head and lock the head to a desired position, and the handles are designed to be squeezed together to thereby allow said contact surfaces of the first and the second top ends of the first and second components to move towards one another.

In another embodiment, the protrusion comprises a central aperture and the device further comprises a pin for securing the head to the handle by insertion of the pin into the aperture of the protrusion. In still another embodiment, the device further comprises a mechanism for activating the release and the locking of the head in a desired position. In yet another embodiment, the release and locking device comprises a pin and a spring.

In still yet another embodiment, the head is designed to rotate about an axis from about 0 degrees to about 180 degrees. In a further embodiment, the bottom end of said handle comprises a grip. In another further embodiment, the release and locking device comprises push mechanism. In still further embodiment, the contact surfaces function as clamping contact surfaces, and the device functions as a clamping device. In yet a further embodiment, the clamping device functions as pliers.

In another embodiment, each of the contact surfaces of the first and the second top ends of the first and second components comprises cutting surfaces, and the device functions as a cutting device. In yet another embodiment, the cutting device functions as snips. In still another embodiment, the cutting device functions as scissors.

In a further embodiment, the present invention provides for a device having adjustable handles and an adjustable head, and the device comprises: a pair of handles having opposing top and bottom ends, the top end of each of the handles has a U-shaped component; a head comprising a first and second component, each of the components has opposing top and bottom ends, the top end of each of the components having at least one contact surface, the bottom end of each of the components comprises a protrusion designed to interact with the U-shaped component of the top end of each of the handles, and the protrusion has a plurality of grooves, the first and second components are connected at a pivot point; and a device for engaging the grooves of the protrusion to thereby allow movement of the head and lock the head to a desired position, and the device comprises a sliding mechanism which engages the grooves.

In another further embodiment, the protrusion comprises a central aperture and the device further comprises a pin for securing the head to the handle by insertion of the pin into the aperture of the protrusion. In still another embodiment, the head is designed to rotate about an axis from about 0 degrees to about 180 degrees. In yet another embodiment, the contact surfaces function as clamping contact surfaces, and the device functions as a clamping device. In still another embodiment, each of the contact surfaces of the first and the second top ends of the first and second components comprises cutting surfaces, and the device functions as a cutting device.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

FIGS. 9*a-e* are perspective views of FIG. 2 showing the movement of the adjustable head of the pliers of the present invention and showing the contact surfaces of the head in a closed position;

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessary to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Figure 1:
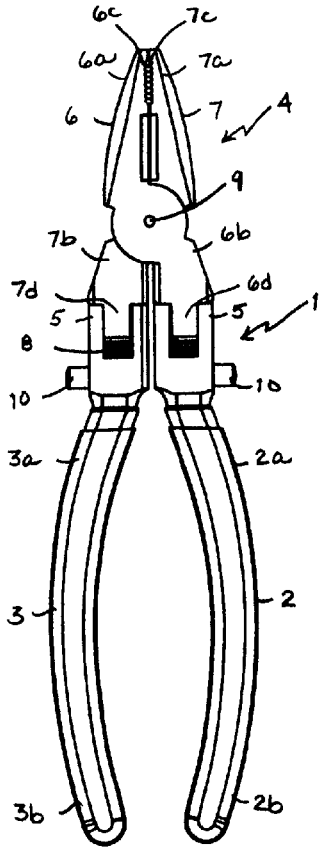
FIG. 1 is a front perspective view of one of the embodiments of the present invention, in particular, pliers with adjustable handles and an adjustable head and one embodiment of the adjustment and locking mechanism.
Figure 2:
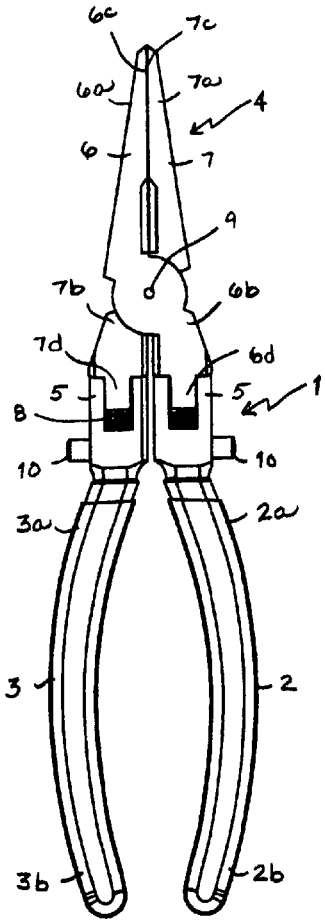
FIG. 2 is a front perspective view of another embodiment of the present invention, in particular, snips with adjustable handles and an adjustable head.
Figure 3:
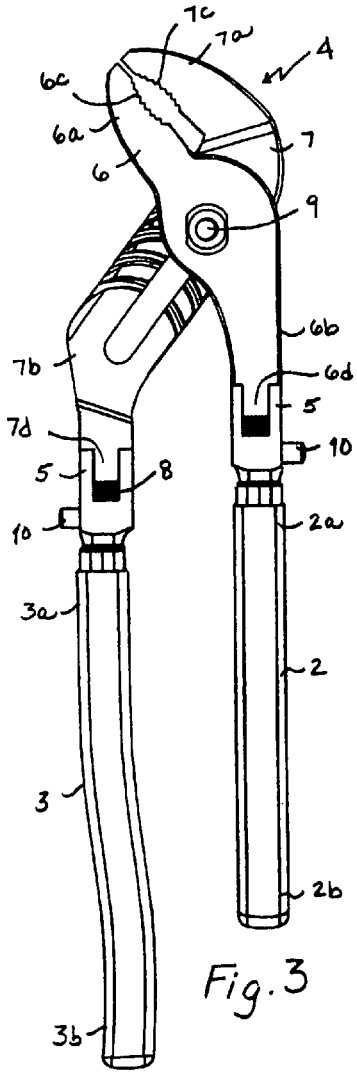
FIG. 3 is a front perspective view of another embodiment of the present invention, in particular, adjustable plier wrench with adjustable handles and an adjustable head.

FIG. 1-3 illustrates one of the embodiments of the present invention, more specifically, a device 1 having adjustable handles 2 and 3, respectively and an adjustable head 4. The device 1 comprises: a pair of handles 2 and 3, having opposing top ends, 2*a* and 3*a*, respectively, and bottom ends, 2*b* and 3*b* respectively. The top end, 2*a* and 3*a*, of each of the handles 2 and 3 have a U-shaped component 5. The head 4 comprises a first and second component, 6 and 7 respectively. Each of the components, 6 and 7, has opposing top ends, 6*a* and 7*a* respectively, and bottom ends, 6*b* and 7*b* respectively. The top ends 6*a* and 7*a* of each of the components 6 and 7 have at least one contact surface, 6*c* and 7*c*. The bottom ends 6*b* and 7*b* of each of the components 6 and 7 comprises a protrusion, 6*d* and 7*d*, respectively. The protrusions 6*d* and 7*d* have a plurality of external slots 8. The U-shaped component 5 of the handles 2 and 3 are designed to interact with the protrusions 6*d* and 7*d* of the bottom end 6*b* and 7*b* of each of the first and second components, 6 and 7, of the head 4. The first and second components 6 and 7 are connected at a pivot point 9. The device further comprises a device 10 for engaging the slots 8 of the protrusions, 6*d* and 7*d* to thereby allow movement of the head 4 and lock the head 4 to a desired position, and the handles 2 and 3 are designed to be squeezed together to thereby allow the contact surfaces 6*c* and 7*c* of the first and the second top ends of the first and second components 6 and 7 to move towards one another. FIG. 1 refers specifically to clamping or holding devices such as pliers. FIG. 2 refers specifically to cutting or snipping devices such as snips. In FIG. 2, the contact surfaces, 6*c* and 7*c*, have sharp edges or cutting surfaces. FIG. 3 refers to adjustable plier wrenches.

Figure 4:
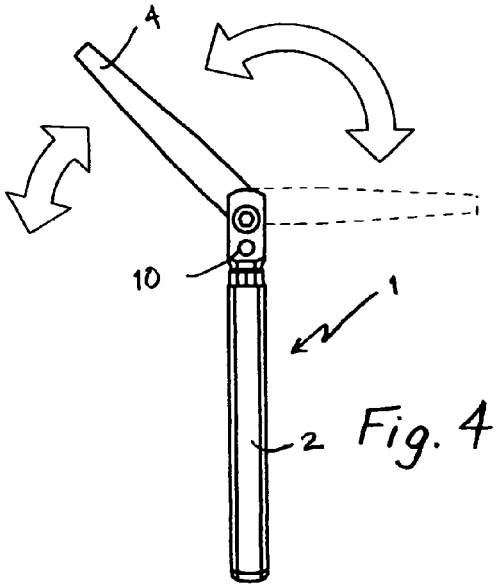
FIG. 4 is a side perspective view of FIG. 1 showing the movement of the head of the pliers.
Figure 5:
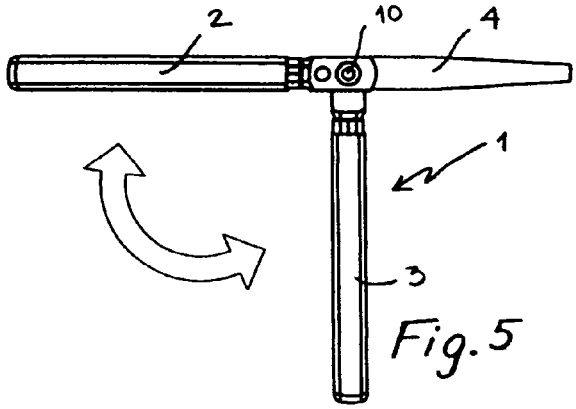
FIG. 5 is a side perspective view of FIG. 1 showing the movement of the handle.

FIG. 4 shows how the head 4 of the device 1 is designed to rotate about an axis from about 0 degrees to about 180 degrees. In another embodiment, the head 4 can rotate about an axis greater than 180 degrees and less than 360 degrees. FIG. 5 refers to how the first handle 2 is also movable in various positions relative to both the second handle 3 and the head 4.

Figure 6:
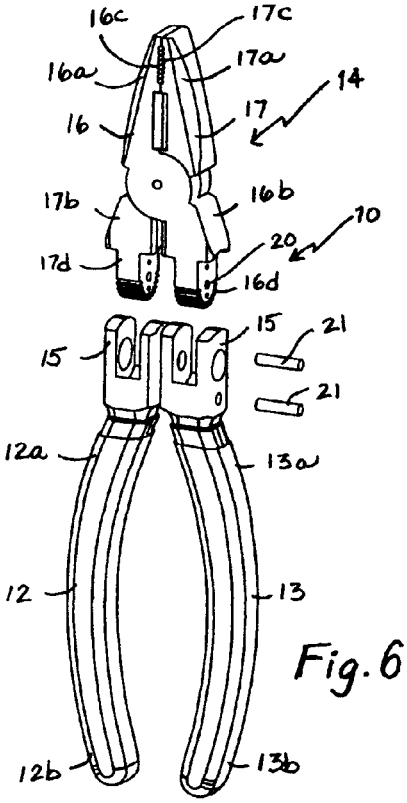
FIG. 6 is an exploded view of the components of another embodiment of the present invention using the apertures in the protrusion of top side of the handle with a push button mechanism.

FIG. 6 shows another embodiment of the invention, more specifically, a device 10 having adjustable handles, 12 and 13 respectively and an adjustable head 14. The device 10 comprises: a pair of handles, 12 and 13, having opposing top ends, 12*a* and 13*a*, and bottom ends 12*b* and 13*b*. The top ends 12*a* and 13*a* of each of the handles 12 and 13 have a U-shaped component 15. The head 14 comprising a first and second component 16 and 17, and each of the components having opposing top ends 16*a* and 17*a*, and bottom ends 16*b* and 17*b*. The top end 16*a* and 17*a* of each of the components have at least one contact surface, 16*c* and 17*c*. The bottom end, 16*b* and 17*b*, of each of the components comprises protrusions, 16*d* and 17*d* respectively, and the protrusions 16*d* and 17*d* have a plurality of apertures 20, and the U-shaped component 15 of the handles 12 and 13 are designed to interact with the protrusions 16*d* and 17*d*, of the bottom ends of each of the head 14. The first and second components 16 and 17 are connected at a pivot point 19. The device 10 further comprises a device 21 for engaging the apertures 20 of the protrusions 16*d* and 17*d* to thereby allow movement of the head 14 and lock the head 14 to a desired position, and the handles 12 and 13 are designed to be squeezed together to thereby allow said contact surfaces 16*c* and 17*c* of the first and the second top ends of the first and second components 16 and 17 to move towards one another.

Figure 7:
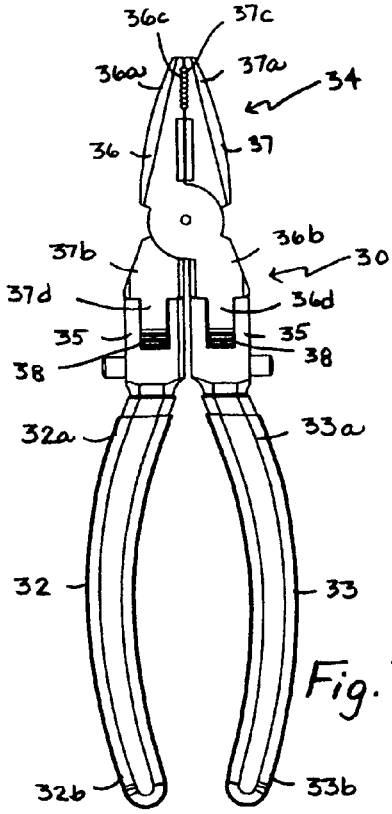
FIG. 7 is a frontal perspective view of another embodiment of the present invention with a sliding mechanism.

FIG. 7 relates to another embodiment of the present invention, more specifically, a device 30 having adjustable handles, 32 and 33, and an adjustable head 34. The device 30 comprises: a pair of handles 32 and 33 having opposing top ends 32*a* and 33*a* respectively, and bottom ends, 32*b* and 33*b*. The top ends 32*a* and 33*a* of each of the handles has a U-shaped component 35. The head 34 comprises a first and second component, 36 and 37 respectively. Each of the components 36 and 37 has opposing top ends 36*a* and 37*a* respectively, and bottom ends, 36*b* and 37*b* respectively. The top ends 36*a* and 37*a* of each of the components having at least one contact surface 36*c* and 37*c*. The bottom ends 36*b* and 37*b* of each of the components comprises protrusion 36*d* and 37*d* respectively, designed to interact with the U-shaped component 35 of the top ends of each of the handles 32 and 33. The protrusions 35 have a plurality of grooves 38. The first and second components 36 and 37 are connected at a pivot point 39. The device 30 further comprises a device 40 for engaging the grooves 38 of the protrusion 35 to thereby allow movement of the head 34 and lock the head 34 to a desired position, and the device 40 comprises a sliding mechanism which engages the grooves 38.

Figure 8:
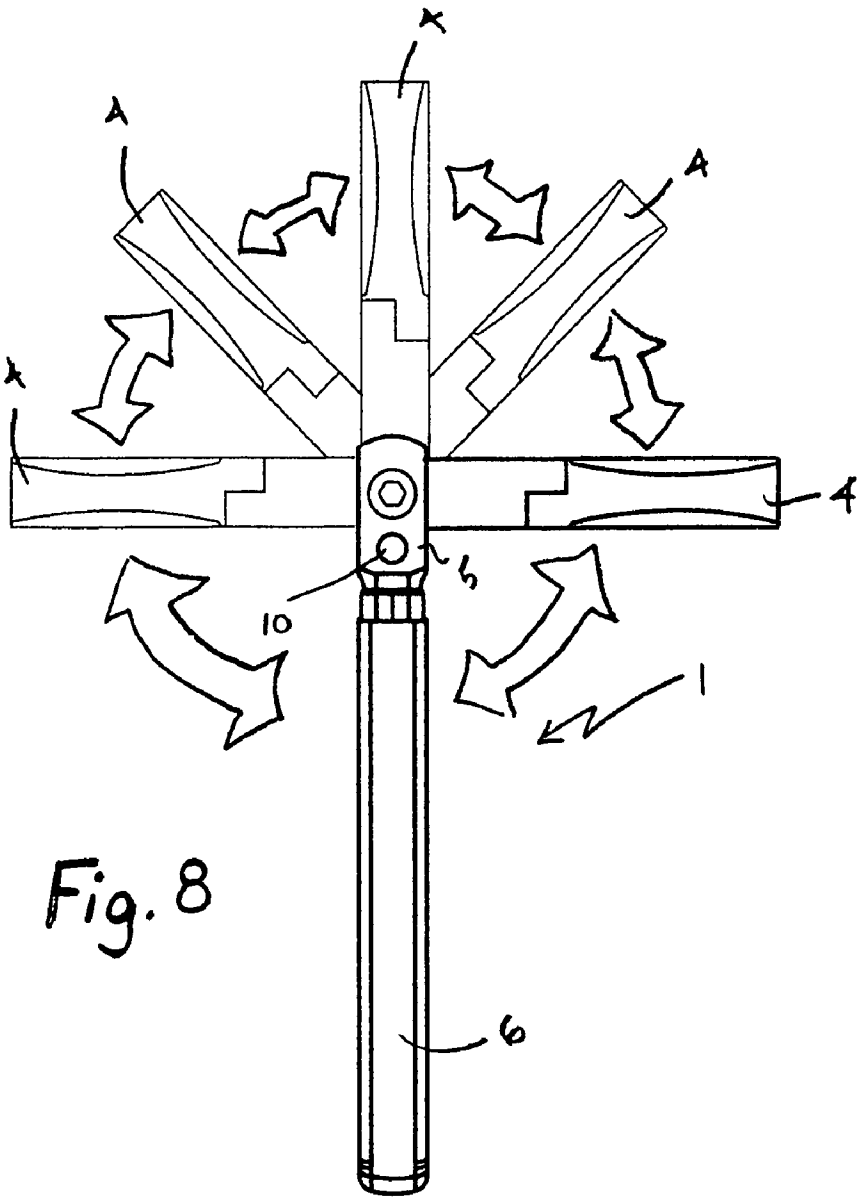
FIG. 8 is a side view of FIG. 1 illustrating the multiple angles of adjustable head of the present invention.
Figures 10A, 10B, 10C, 10D, 10E:
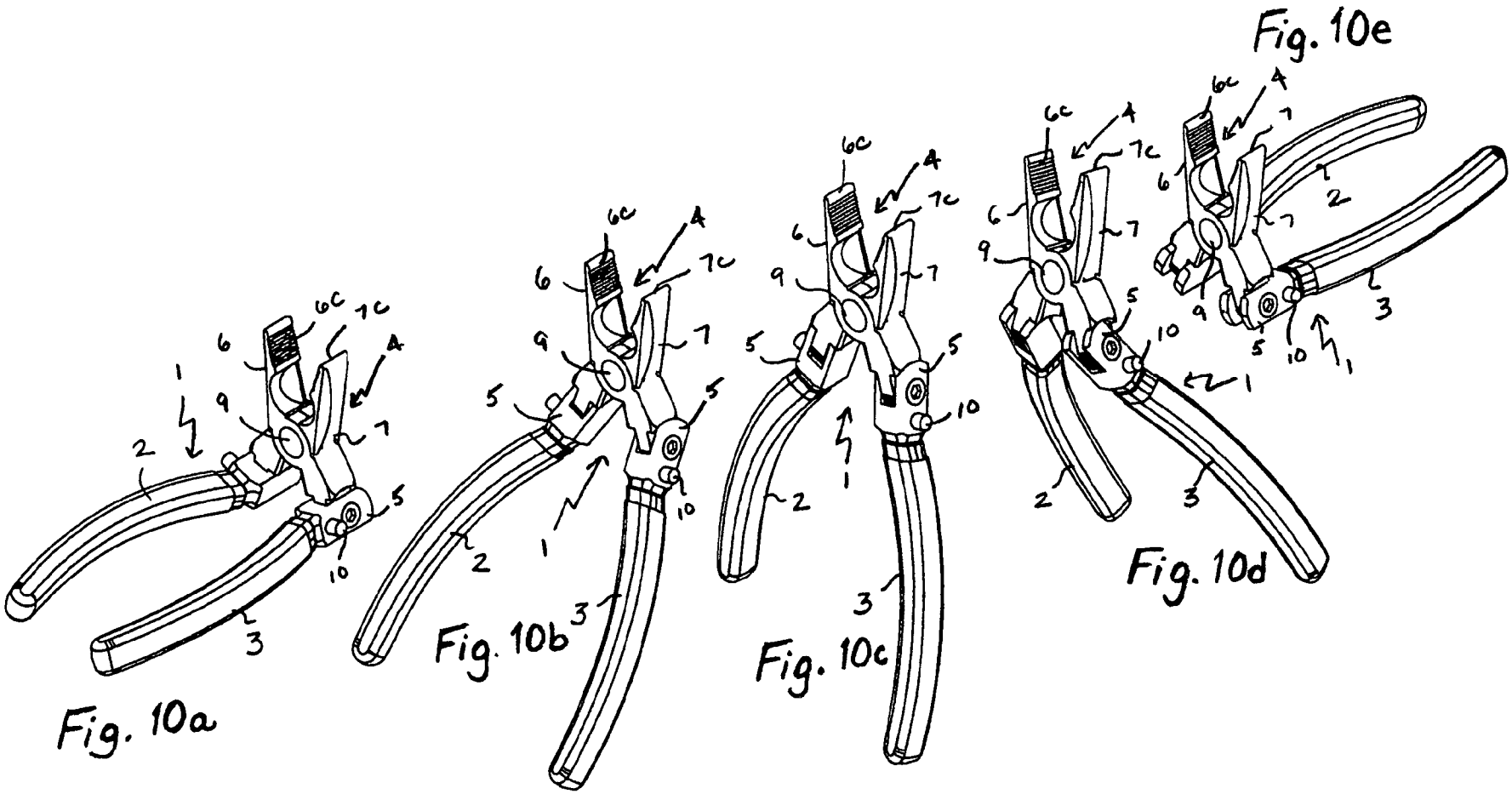
FIGS. 10*a-e* are perspective views of FIG. 2 showing the movement of the handles in the same direction and showing the contact surfaces of the head in an open position.

FIG. 8 illustrates a side view of FIG. 1 which shows the multiple angles the head 4 can move relative to handle 6. In one embodiment, the head 4 can rotate about the u-shaped component 5 greater than 0 degrees and less than 360 degrees. The device 10 allows the head 4 to be locked into the desired angles. This allows the head 4 of the device 1 to be inserted into various tight areas.

FIGS. 9*a-e* show the movement of the head 4 of the device 1 about an axis created by the u-shaped component 5. The contact surfaces of the first and second components, 6 and 7 respectively, are in contact with one another thereby forming the closed position or clamped position or cutting position.

FIGS. 10*a-e* show the movement of the handles, 2 and 3 respectively, of the device 1 if the head 4 was set in a stationary vertical position. In this embodiment, the u-shaped components 5 rotate about the protrusions, 6*d* and 7*d* respectively creating angles greater than 0 degrees and less than 360 degrees. The contact surfaces, 6*c* and 7*c* respectively, of the first and second components, 6 and 7 respectively, are not in contact with one another thereby forming the opened position or ready to clamp or cut positions. The first and second component, 6 and 7, rotate about a pivot point 9 to create the opening and closing positions.

Figures 11A, 11B, 11C:
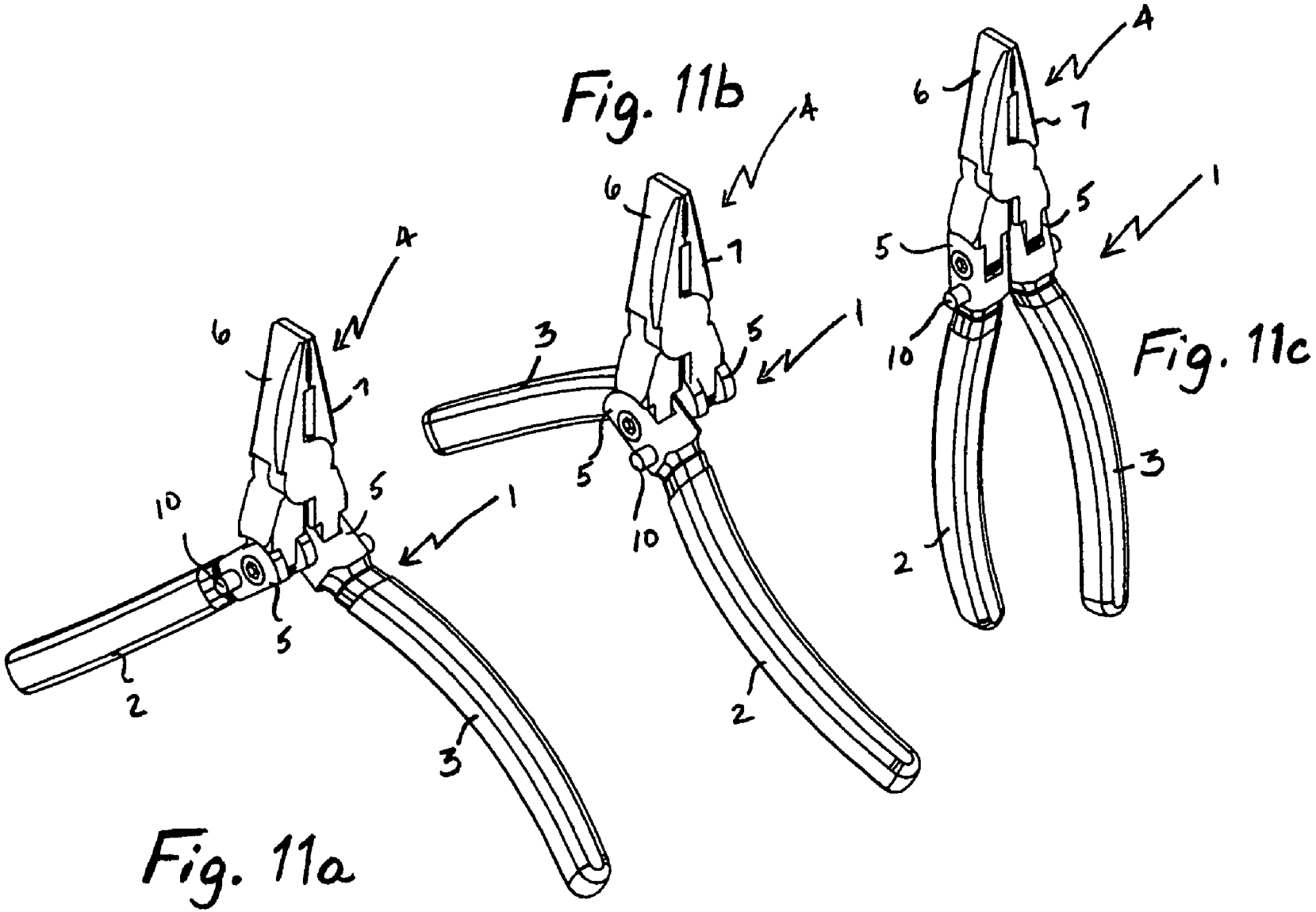
FIGS. 11*a-c* are perspective views of FIG. 2 showing the movement of the handles in opposite directions.

FIGS. 11*a-c* show how the handles, 2 and 3, of the device 1 can move independently of one another in opposite directions. The locking or engaging device 10 allows the handles to also be locked in various angles and be situated opposite of one another as shown in FIGS. 11*a* and 11*b*, as well as being together on the same plane as shown in FIG. 11*c*.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A device having an adjustable handle and head, said device comprising:

a pair of handles having opposing top and bottom ends, said top end of each of said handles having a U-shaped component;

a head comprising a first and second component, each of said components having opposing top and bottom ends, said top end of each of said components having at least one contact surface, said bottom end of each of said components comprising a protrusion, said protrusion having a plurality of internal apertures, said U-shaped component of said handles designed to interact with said protrusion of said bottom end of each of said first and second components of said head, said first and second components being connected at a pivot point; and a device for engaging said internal apertures of said protrusion to thereby lock said head to a desired position, during a locked position, at least a portion of a length of said device is situated within a first internal aperture, the position of said head is moved to different angle by removing said device from said first internal aperture and inserting said device to a second aperture, a length of said aperture is situated on a plane generally parallel to said length of said device during said locked position, said handles are designed to be squeezed together to thereby allow said contact surfaces of said first and said second top ends of said first and second components to move towards one another.

2. The device of claim 1 further comprising a mechanism for activating the release and the locking of said head in a desired position.

3. The device of claim 2 wherein said release and locking device comprises a pin and a spring.

4. The device of claim 2 said release and locking device comprises push mechanism.

5. The device of claim 2 said release and locking device comprises sliding mechanism.

6. The device of claim 1 wherein said protrusion comprises an aperture and said device further comprises a pin for securing said head to said handle by insertion of said pin into said aperture of said protrusion.

7. The device of claim 1 wherein said head is designed to rotate about an axis greater than 0 degrees to less than 360 degrees.

8. The device of claim 1 wherein said contact surfaces function as clamping contact surfaces, said device functions as a clamping device.

9. The device of claim 8 wherein said clamping device functions as pliers.

10. The device of claim 1 wherein said internal apertures of said protrusion functions as a chamber.

11. The device of claim 1 wherein said each of said contact surfaces of said first and said second top ends of said first and second components comprises cutting surfaces, said device functions as a cutting device.

12. The device of claim 11 wherein said cutting device functions as snips.

13. The device of claim 11 wherein said cutting device functions as scissors.

14. A device having an adjustable handle and head, said device comprising:

a pair of handles having opposing top and bottom ends, said top end of each of said handles having a U-shaped component;

a head comprising a first and second component, each of said components having opposing top and bottom ends, said top end of each of said components having at least one contact surface, said bottom end of each of said components comprising a protrusion designed to interact with said U-shaped component of said top end of each of said handles, said protrusion having a plurality of external grooves, said external grooves having a lateral surface situated along a length of each of said grooves, said first and second components being connected at a pivot point; and a device for engaging said external grooves of said protrusion to thereby lock said head to a desired position, during a locked position, at least a portion of a length of said device contacts and engages at least a portion of said lateral surface of a first external groove, the position of said head is moved to a different angle by disengaging said device from said first external groove and allowing said device to engage a second external groove, said length of said groove is situated on a plane generally parallel to said length of said device during said locked position.

15. The device of claim 14 wherein said protrusion comprises a central aperture and said device further comprises a pin for securing said head to said handle by insertion of said pin into said aperture of said protrusion.

16. The device of claim 14 wherein said head is designed to rotate about an axis greater than 0 degrees and less than 360 degrees.

17. The device of claim 14 wherein said contact surfaces function as clamping contact surfaces, said device functions as a clamping device.

18. The device of claim 17 wherein said clamping device functions as pliers.

19. The device of claim 14 wherein said each of said contact surfaces of said first and said second top ends of said first and second components comprises cutting surfaces, said device functions as a cutting device.

20. The device of claim 19 wherein said cutting device functions as snips.

21. The device of claim 19 wherein said cutting device functions as scissors.

22. The device of claim 14 further comprising a mechanism for activating the release and the locking of said head in a desired position.

23. The device of claim 22 wherein said release and locking device comprises a pin and a spring.

24. The device of claim 22 said release and locking device comprises push mechanism.

25. The device of claim 14 wherein said head is designed to rotate about an axis from about 0 degrees to about 180 degrees.

26. The device of claim 14 wherein said bottom end of said handle comprises a grip.

* * * * *